US010264855B1

(12) United States Patent
Jeanty

(10) Patent No.: US 10,264,855 B1
(45) Date of Patent: Apr. 23, 2019

(54) BELT SECURING DEVICE

(71) Applicant: Leif Jeanty, Miami, FL (US)

(72) Inventor: Leif Jeanty, Miami, FL (US)

( * ) Notice: Subject to any disclaimer, the term of this patent is extended or adjusted under 35 U.S.C. 154(b) by 144 days.

(21) Appl. No.: 15/247,859

(22) Filed: Aug. 25, 2016

Related U.S. Application Data

(60) Provisional application No. 62/210,095, filed on Aug. 26, 2015.

(51) Int. Cl.
*A44B 11/16* (2006.01)

(52) U.S. Cl.
CPC ..... *A44B 11/16* (2013.01)

(58) Field of Classification Search
CPC ..... Y10T 24/1394; Y10T 24/1391; Y10T 24/1997; A44B 11/16
See application file for complete search history.

(56) References Cited

U.S. PATENT DOCUMENTS 928,006 A * 7/1909 Thomas ..... A45F 5/02 24/3.6
1,281,656 A * 10/1918 Raschick ..... A45F 5/02 24/3.12
1,364,709 A * 1/1921 Butler ..... A45F 5/02 24/3.12
1,381,846 A * 6/1921 Maker ..... A44B 6/00 24/563
2,994,116 A * 8/1961 Anderson ..... A44B 6/00 24/66.13
5,129,126 A * 7/1992 Huang ..... A44B 99/00 224/669
2005/0223525 A1* 10/2005 Wartian ..... A42B 1/24 24/3.12

* cited by examiner

*Primary Examiner* — Robert Sandy

(57) ABSTRACT

A belt clip is provided for retaining an excess amount of belt material about a waist of a user. The disclosed belt clip generally includes a preferably U-shaped body portion having an elongate, preferably straight first portion, a preferably curved middle portion and an elongate second portion. The first and second portions define a channel therebetween for receipt of a length of belt material. An arcuate spring member is provided and has a first end, a middle portion and a second end. The first end of the spring member is attached to a free, first end of the second portion and the middle portion of the spring member has a concave surface and a convex surface. The belt clip can additionally include a plate extending from the first portion for display of indicia or images.

18 Claims, 4 Drawing Sheets

BELT SECURING DEVICE

CROSS-REFERENCE TO RELATED APPLICATION

This application claims the benefit of U.S. Provisional Patent Application Ser. No. 62/210,095, filed Aug. 26, 2015, which is incorporated herein by reference in its entirety.

FIELD OF THE INVENTION

The present invention relates generally to belt securing devices or belt clips and, more particularly, to a belt clip including a spring biased member for releasably securing a free end of a belt worn by a user to a body of the belt.

BACKGROUND OF THE INVENTION

In men's attire, belts are used to support pants at the waist to prevent them from falling down. Additionally, a belt may be decorative and add to and/or enhance the appearance on one's ensemble. A belt typically includes a length or strap of material and a buckle or other fastener to secure the belt back on itself. The buckle is typically secured to one end of the belt. The belt may be formed from a variety of natural or synthetic materials such as, for example cotton or leather, plastic or polymeric threads or cords, etc. The buckle is typically formed of a metallic or polymeric material.

In use, a free end of the belt is passed around the pants and through the buckle after which the free end is pulled to tighten the belt about the user and the buckle used to secure the belt in place. Often the pants have loops to receive the belt and help more evenly distribute the weight of the pants about the waist of the user. Some buckles include a protruding button which engages corresponding hole spaced evenly along the free end of the belt. By inserting the button through the desired hole, the belt is held in place on the user. Alternatively, some buckles are designed to cinch down on the free end of the belt to hold it in friction fit fashion.

Often there is an excessive amount of the free end of the belt which extends past the buckle after the belt has been drawn tight. Also when worn, the free end may dangle between the above described loops, being too short or too long to be secured to the body by the loops. This is most often the case where a user has lost a significant amount of weight and thus girth. Alternatively, the belt chosen may have simply been too long to begin with, When one tries to be neat in their attire, an excess amount of the free end of the belt can be troublesome, unsightly and a nuisance. Typically, the user tries to thread the excess free end through a nearby belt loop on the pants. However, the belt loops on the pants are rarely in a convenient or useful position and some free end amount of the belt still dangles and flops around in an unsightly manner.

Accordingly, there is an established need for a device for securing an excess length of belt material after the free end of the belt has passed through the belt buckle. There is also a further need for a device which can neatly retain the excess belt material while enhancing the appearance of the user,

SUMMARY OF THE INVENTION

The present invention is directed to a novel belt clip for retaining an excess amount of belt material in a neat and orderly fashion. The belt clip can easily and conveniently attach to the belt and secure the excess length of belt material after the free end of the belt has passed through the belt buckle. The belt clip is also easily removable from the belt for storage or usage in a different outfit.

In a first implementation of the invention, a belt clip for retaining an excess amount of belt material of a belt includes a body portion and an arcuate spring member. The body portion has a first portion, a middle portion and a second portion arranged in a spaced-apart relationship with the first portion. The first portion includes a free, first end and a second end extending from the middle portion. The second portion includes a first end and a second end extending from the middle portion. The arcuate spring member has a first end, a middle portion and a second end, the first end of the spring member extending from the first end of the second portion and the middle portion of the spring member having a concave surface and a convex surface.

In a second aspect, the body portion can be generally U-shaped.

In another aspect, the middle portion can be curved.

In another aspect, the first and second portions can define a channel therebetween for receipt of a section of a belt and the spring member can extend from the first end of the second portion through the channel to a point adjacent an inner surface of the middle portion.

In another aspect, the convex surface of the spring member can face an inner surface of the first portion and the concave surface of the spring member can face an inner surface of the second portion.

In yet another aspect, the spring member can be more flexible than the body portion.

In yet another aspect, the middle portion of the spring member can include a slot.

In another aspect, the second portion of the body portion can include a bend separating an entrance end portion of the second portion from a channel portion of the second portion. The bend can cause the entrance end portion to angle away from the first end of the first portion to create a flared entrance opening in a channel defined between the first and second portions.

In yet another aspect, the belt clip can further include a plate extending from the first portion of the body portion, the plate and first portion having a total thickness greater than the thickness of the second portion of the body portion. The plate can include at least one of indicia, an alphanumeric character and an image on an outer surface thereof. The plate can be removably attachable to the first portion of the body portion. For instance, the plate can be slidably insertable within a receiving channel formed on the first portion of the body portion. The first portion can include first and second raised sides and a raised end wall defining the receiving channel. The plate can be removably secured within the receiving channel in friction fit fashion.

In another aspect, the belt clip can further include a button for engagement with the belt, the button extending from an inner surface of one of the first or second portion of the body portion towards the other of the first or second portion of the body portion. For instance, the button can extend from an inner surface of the first portion towards the convex surface of the spring member. Alternatively, the button can extend from the convex surface of the spring member towards an inner surface of the first portion.

In another implementation of the invention, a belt clip for retaining an excess amount of belt material of a belt includes a generally U-shaped body portion and an arcuate spring member. The body portion has a first portion, a second portion arranged in a spaced-apart relationship with the first portion, and a curved middle portion connecting the first and second portions. The first portion includes a free, first end and a second end extending from the middle portion. The second portion includes a first end and a second end extending from the middle portion. The arcuate spring member has a first end, a middle portion and a second end. The first end of the spring member is attached to the first end of the second portion. The middle portion of the spring member has a concave surface and a convex surface.

In yet another implementation of the invention, a belt clip for retaining an excess amount of belt material of a belt includes a generally U-shaped body portion and an arcuate spring member. The body portion has a first portion, a curved middle portion and a second portion. The first portion includes a free, first end a second end extending from the middle portion. The second portion includes a first end and a second end extending from the middle portion, wherein the first portion and the first end of the second portion form a flared entrance opening into a channel defined between the first and second portions. The arcuate spring member extends into the channel and has a first end, a middle portion and a second end. The first end of the spring member is attached to the first end of the second portion. The middle portion of the spring member has a concave surface and a convex surface, wherein the concave surface is arranged facing an inner surface of the first portion of the body portion.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
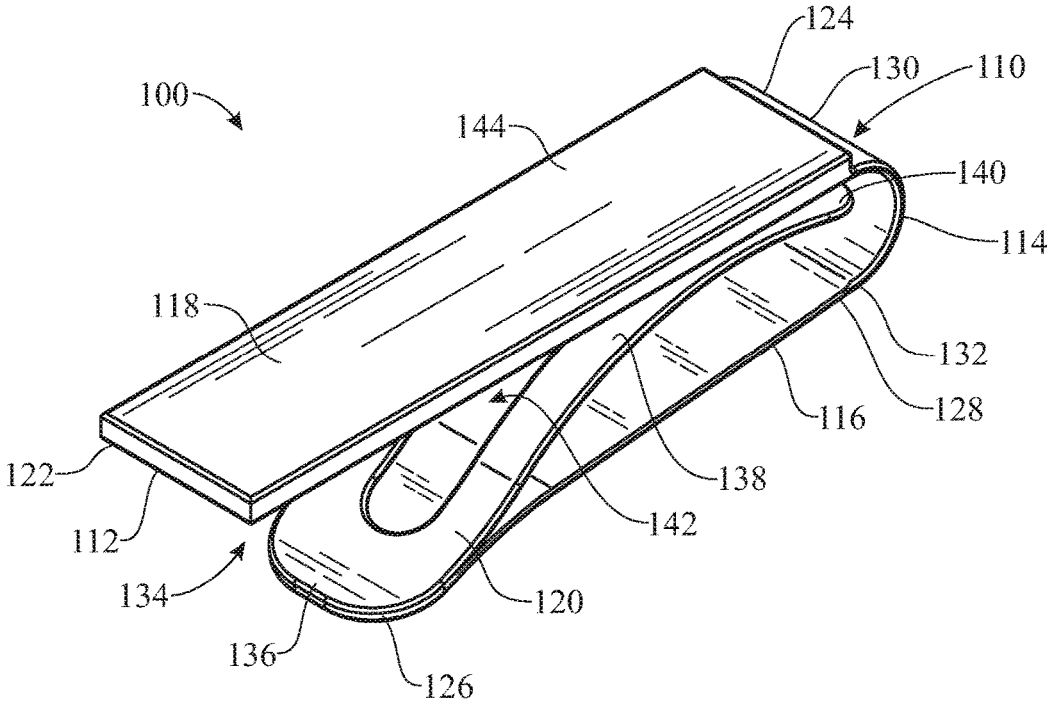
FIG. 1 presents an isometric top view of one embodiment of a belt securing clip of the present invention.
Figure 2:
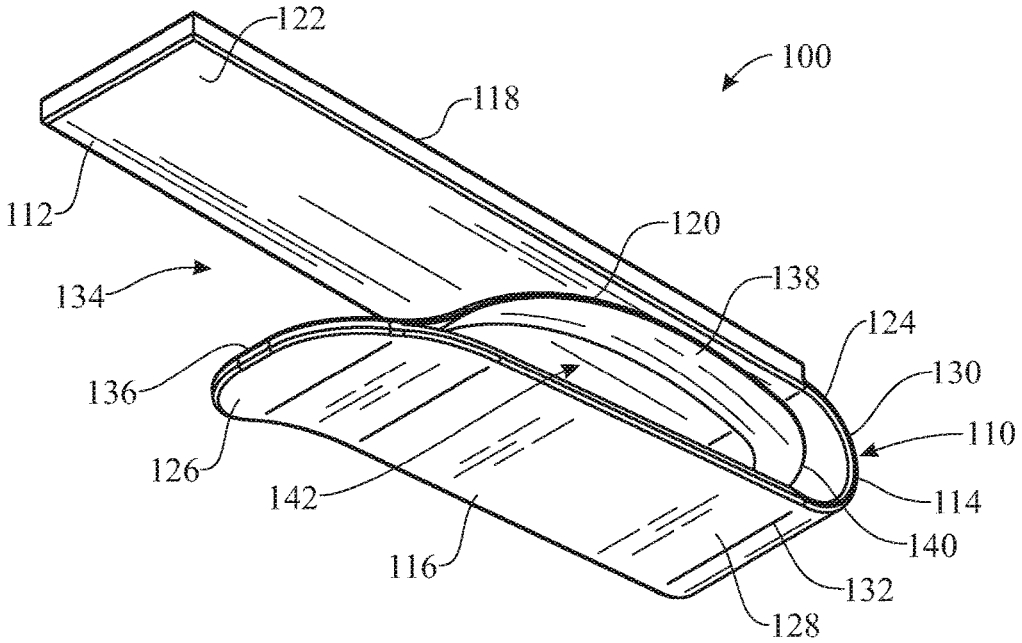
FIG. 2 presents an isometric bottom view of the belt securing clip of the present invention.

Referring initially to FIGS. 1 and 2, a belt clip 100 is illustrated in accordance with a first exemplary embodiment of the present invention. The belt clip 100 is provided to be releasable affixed to a belt to secure a free or loose end of the belt to the remainder of the belt. The belt clip 100 generally includes a body portion 110 having an elongate, generally rectangular first portion 112, a middle portion 114 and an elongate second portion 116. The middle portion 114 can be arcuate or U-shaped, as shown; however, alternative embodiments are contemplated. An enlarged thickness, member or plate 118 extends from the first portion 112 for fashion or other purposes as described in more detail hereinbelow. The belt clip 100 further includes a biased spring member 120 which is attached to the second portion 116. The spring member 120 is positioned between the first and second portions 112 and 116, respectively, and assists in securing sections of a belt together.

As shown, in order to form the generally U-shape of the belt clip, the first portion 112 has a free, first end 122 and a second end 124. Likewise, the second portion 116 has a first end 126 and a second end 128. The second end 124 of the first portion 112 extends from a first end 130 of the middle portion 114, and the second end 128 of the second portion 116 extends from a second end 132 of the middle portion 114. Together, the free, first end 122 of the first portion 112 and the first end 126 of the second portion 116 form or define an opening or gap 134 therebetween for receipt of sections of a user's belt as described in more detail hereinbelow.

Figure 3:
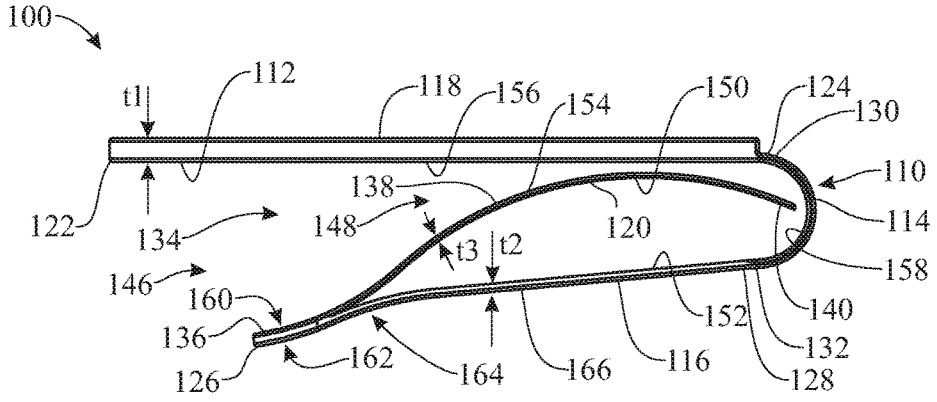
FIG. 3 presents a side elevation view of the belt securing clip of the present invention.

The spring member 120 has a generally arched shape and includes a first end 136, a middle portion 138 and a second end 140. The first end 136 of the spring member 120 can be affixed to or integral with the second portion 116 at the first end 126 thereof, as shown in FIGS. 1-3. The spring member 120 extends proximally into the gap 134 formed between the first and second portions 112 and 116, respectively, and toward the middle portion 114 of the spring clip 100. The first end 136 of the spring member 120 may be affixed to the first end 126 of the second portion 116 or any part of the spring clip 100 by known methods, such as welding, fusing, gluing, etc. Alternatively, the spring member 120 may be integrally formed with the second portion 116 of the body portion 110 of the belt clip 100. In order to increase the flexibility of the spring member 120, and thereby further assist in securing the belt portions, the middle portion 138 of the spring member 120 includes a hollow slot or channel 142 extending between the first and second ends 136 and 140 of the spring member 120.

It should be noted that the essentially monolithic structure of the body portion 110 of the spring clip 100 may be formed from a variety of flexible metallic or polymeric materials, such as, for example, spring steel, stainless steel, brass, copper or alloys thereof, plastics or other copolymers, etc. The first portion 112, the middle portion 114 and the second portion 116 may be integrally formed or may be first formed or molded as separate structures and subsequently connected together by known methods such as, for example, fusing, welding, gluing, etc.

Additionally, the spring member 120 may be formed from a similar variety of materials as the body portion 110. In an exemplary embodiment, the material chosen for the spring member 120 has a greater flexibility that the materials chosen for the body portion 110. This allows the spring member 120 to compress against the belt portions and bias the belt portions against the first portion 112 of the body portion 110 without causing the first and second portions 112 and 116, respectively, of the body portion to splay apart.

The plate 118 may be formed from materials similar to those used to form the body portion 110 and may further include relatively non-flexible materials such as, for example, ceramics, rigid polymers, rigid metallic alloy such as brass, etc. When formed from the same material as the body portion 110 the plate 118 may be formed integrally with the body portion 110 and, more specifically, with the first portion 112 of the body portion 110 to form a monolithic structure.

The plate 118 is primarily provided for fashion purposes and may include a variety of indicia, one or more alphanumeric characters (e.g. a text), images or designs, or other visual displays (not shown) on an upper surface 146 thereof (FIG. 1). The indicia or designs may include sports logos, company logos, humorous or inspirational sayings or designs. Further, the visual displays may include pictures of a user's pets, family members or hero's, etc. Alternatively, black and white or color patterns or the like may be provided to conform to and enhance the color scheme of the user's clothes. Alternatively or additionally, the plate 118 can be customized to different shapes, designs, and materials to complement the user's fashion desires.

Turning now for the moment to FIG. 3, the gap 134 defined between the first portion 112 and the second portion 116 of the body portion 110 includes an entrance opening 146 and a channel 148 extending between the first portion 112 and the second portion 116. Specifically, the entrance opening 146 is defined by the respective first ends 122 and 126 of the first and second portions 11.2 and 116.

The spring member 120 extends proximally from the first end 126 of the second portion 116 into the channel 148 toward the middle portion 114. The spring member 120 has a generally arched shape and includes a concave first surface 150 facing an inner surface 152 of the second portion 116 and a convex second surface 154 facing toward a generally planar inner surface 156 of the first portion 112. The second end 140 of the spring member is adjacent an inner surface 158 of the middle portion 114 of the body portion 110 of the spring clip 100. A short, generally flat portion 160 of the spring member 120 is connected to an entrance end portion 162 of the second portion 116 as described hereinabove. It is to be understood that the spring member 120 may be attached to any portion of the spring clip 100 without departing from scope of this disclosure. For example, the spring member 120 may be attached to the first portion 112 and extend in any direction, and more preferably towards the second portion 116.

In order to splay or increase the entrance opening 146 between the first end 122 of the first portion 112 and the first end 126 of the second portion 116, the second portion 116 includes a slight downward or outward bend 164 between the entrance end portion 162 of the second portion 116 and a relatively flat intermediate portion 166 of the second portion 116.

As noted hereinabove and shown in FIG. 3, the relatively rigid plate 118 and first portion 112 have a joint thickness t1 which is greater than a thickness t2 of the body portion 110, and more specifically of the second portion 116 and the middle portion 114. The greater total thickness t1 of the plate 118 and first portion 112 facilitates handling of the belt clip 100 by the user. In turn, the thickness t3 of the spring member 120 may be equal to the thickness t2 of the body portion 110 or may be less than the thickness t2 of the body portion 110 to further increase the flexibility of the spring member 120 relative to the body portion 110, for instance if the spring member 120 and the body portion 110 are made of a same material.

Figure 4:
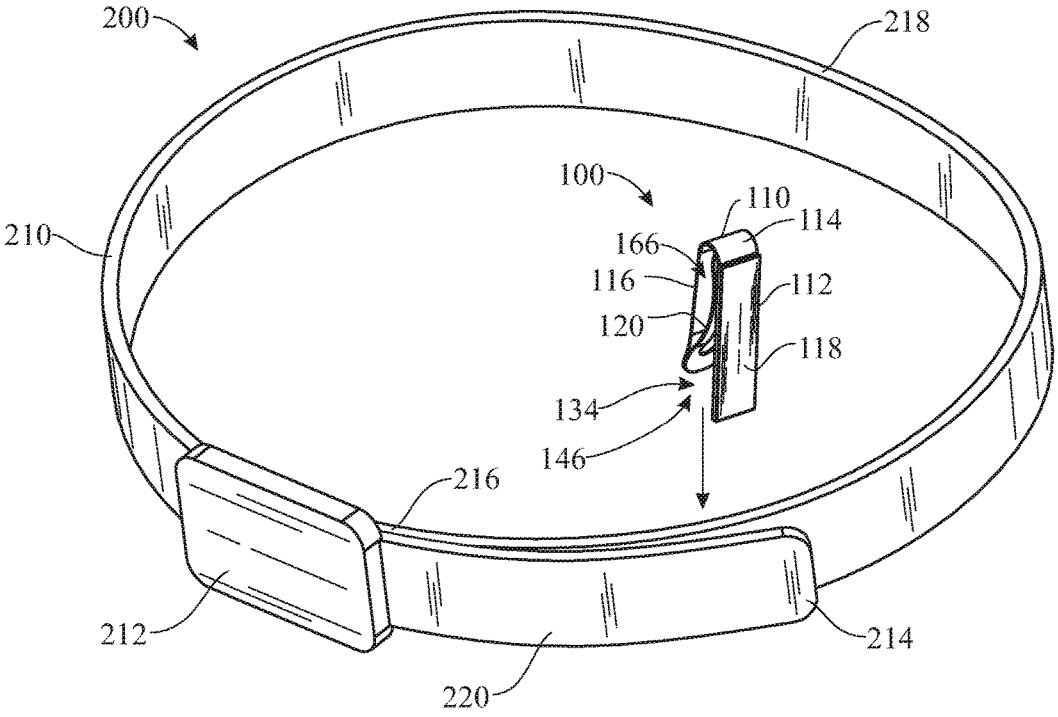
FIG. 4 presents a perspective view of the belt securing clip of the present invention and a belt prior to securing a free end of the belt with the belt securing clip.
Figure 5:
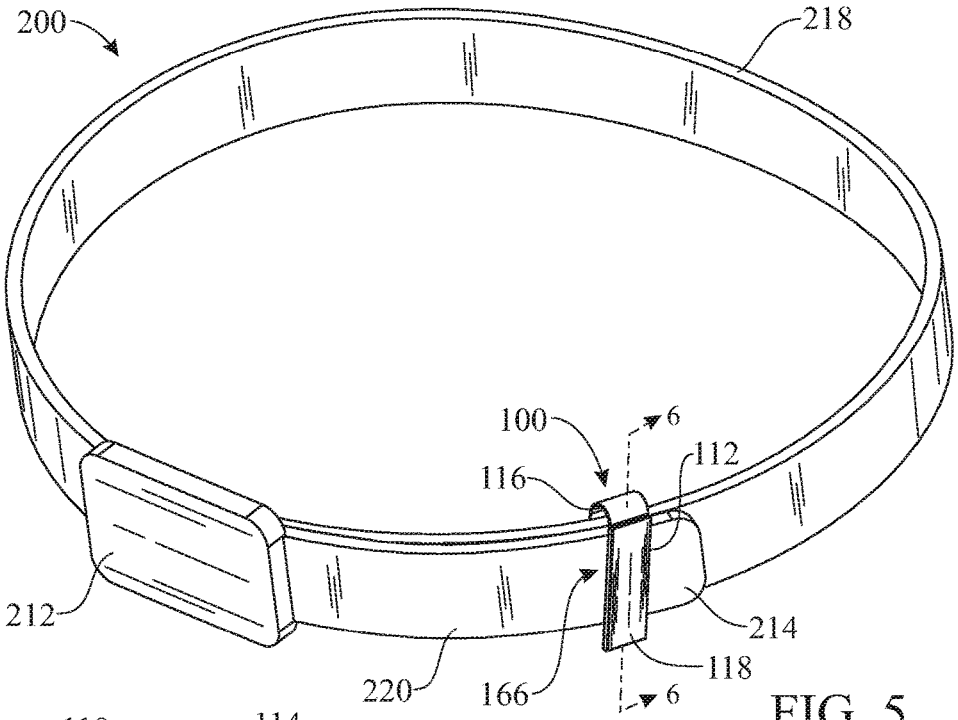
FIG. 5 presents a perspective view; similar to FIG. 4, with the belt securing clip of the present invention attached to the belt to secure the free end of the belt against a side of the belt.
Figure 6:
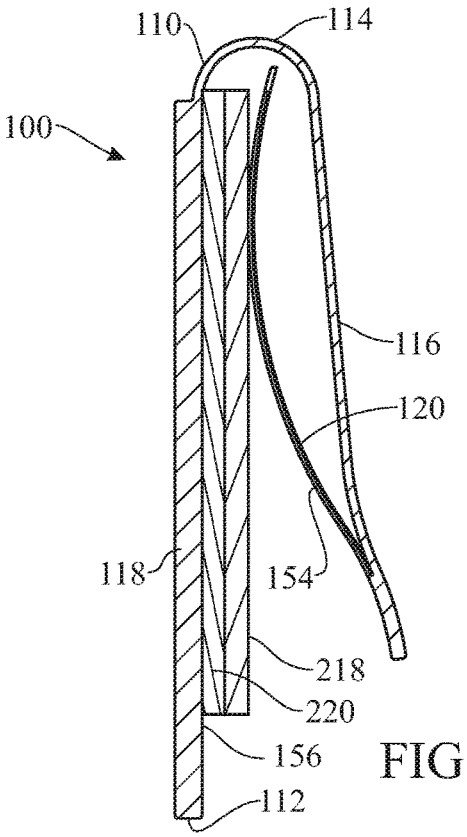
FIG. 6 presents a cross-sectional side elevation view of the bet securing clip and belt of FIG. 5, the section taken along section plane 6-6 indicated in FIG. 5.

Turning now to FIGS. 4-6, in use, the belt clip 100 is provided to secure portions of a belt 200. The belt 200 generally includes a train body portion or strap 210 and a securing member or buckle 212. The strap 210 includes a free end 214, a secured end 216 affixed to the buckle 212 and a body length 218 extending between the free end 214 and the secured end 216. During use, the body length 218 is passed around the body of a user, or through belt loops in pants of the user (not shown) and the free end 214 is passed through the buckle 212 to secure the belt 200 in place. After the free end 214 passes through the buckle 212, a free or loose length 220 of the belt extends past the buckle 212 and is free to flop around. As noted above, this is most often the case where a belt 200 is too long for the user or where the user has lost a great deal of weight. As further noted above, in some fashion instances this is undesirable.

When it is desired to have a neat appearance, with the loose length 220 of the belt 200 constrained, the loose length 220 of the belt 200 is often just tucked into another belt loop on the pants of a user. However, the loose length 220 often easily slips free of the belt loop to the dismay of the user. In order to firmly secure the loose length 220 to the body length 210 of the belt 200, the belt clip 100 is grasped by the user and advanced toward the body length 210 and loose length 220 of the belt 200 with the plate 118 facing outward. As shown in FIG. 4, the entrance opening 146 of the gap 134 defined by the belt clip 100 facilitates advancing the belt clip 100 over the loose length 220 and the body length 210 of the strap 210 of the belt 200, The belt clip 100 is further advanced over the strap 210 of the belt 200 such that the body length 218 and the loose length 220 of the strap 210 enter the channel 148 defined between the first portion 112 of the belt clip 100 and the second portion 116 of the belt clip 100. By inserting the body length 218 and the loose length 220 of the strap 210 into the channel 148, the position of FIG. 5 is reached. More specifically, with reference to FIG. 6, the body length 218 and the loose length 220 of the strap 210 of the belt 200 are positioned between the inner surface 156 of the first portion 112 and the convex second surface 154 of the spring member 120. The spring member 120 biases the body length 218 against the loose length 220 of the strap 210 of the belt 200, and the loose length 220 is consequently pushed against the inner surface 156 of the first portion 112, thus urging or forcing and securing the loose length 220 of the strap 210 against the body length 218 of the strap 210. This firmly captures the loose length 220 of the strap 210 of the belt 200 within the spring clip 100 for a neat appearance. Furthermore, the belt clip 100 may be slid along the length of the belt 200 to capture as much or as little of the loose length 220 against the strap 210 as desired. As noted above, the plate 118 of the belt clip 100 faces outward when the belt clip 100 is in the assembled position (FIG. 5); the plate 118 can present indicia or images thereon for the enjoyment of the user and others. It is to be understood that the belt clip 100 is conveniently detachably securable to the loose length 220 of the belt 200 while the belt 200 is being worn by a user. As such, the belt 200 does not need to be removed from a user to allow attachment of the clip 100.

In this manner, the spring clip 100 provides a novel and useful device for managing the loose length 220 of the belt 200 to prevent and unsightly drooping or flopping around of the loose length 220 while the belt 200 is worn by a user.

Figure 7:
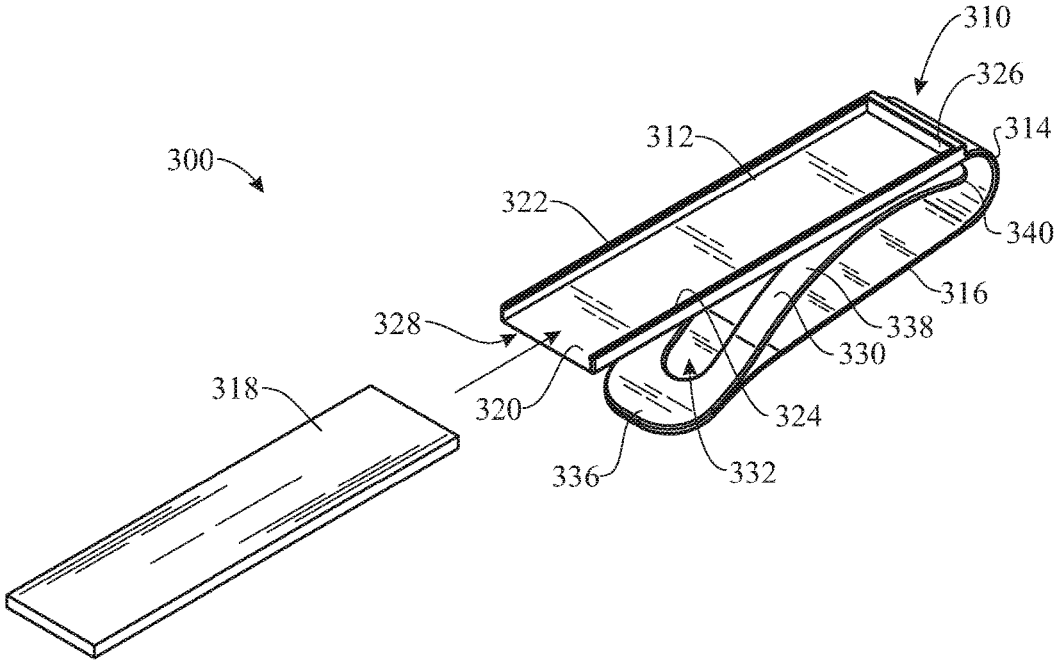
FIG. 7 presents an isometric top view, with parts separated, of another embodiment of a belt securing clip of the present invention having a detachably securable piece that slides into the belt securing clip.

Referring now to FIG. 7, a second embodiment of a belt clip 300 of the present invention is illustrated that is similar to the first embodiment, i.e. to the belt clip 100 of FIGS. 1-6, and generally includes a body portion 310 having a first portion 312, a middle portion 314 and a second portion 316. The body portion 310 is constructed similar to the body portion 110 of the belt clip 100 described hereinabove and is formed from similar materials. In this embodiment, however, one or more plates 318 are provided that are removable from the first portion 312 to allow a user to change different plates 318 having differing indicia or images according to the needs or whim of the user. For example, a user may choose a plate 318 from a set of available plates 318, the selected plate 318 having a design. or color scheme that matches the user's worn apparel, and/or a specific shape, texture, decorative element, design or material, adding further fashionable customization. The plate 318 can be releasably retained on an upper surface 320 of the first portion 312 and detachably secured thereon by raised sides 322 and 324 and a raised end 326. The raised sides 322, 324 and the raised end 326 form a channel 328 for slidably receiving the plate 318. In the depicted embodiment, the raised end 326 is arranged at a first end of the raised sides 322, 324 adjacent to the middle portion 314; however, alternative embodiments are contemplated in which the raised end may be arranged at an opposite, second end of the raised sides 322, 324.

The plate 318 may be releasably retained on the first portion 312 by a friction fit within the channel 328, by magnet means, or by other known means of releasably securing a member within a channel or on a surface. In use, the user chooses the desired plate 318 to match his clothing or to display a particular image and slides the plate 318 into detachable engagement with the first portion 312 within the channel 238. Thereafter, the user places the belt clip 300 over a belt or belt and loose length of a belt, for example belt 200 and loose length 220 described hereinabove, with the plate 318 facing outward to display the chosen plate 318 and secure the loose length of the belt as described hereinabove. The belt clip 300 additionally includes a spring member 330 which is substantially identical to spring member 120 described hereinabove functions in similar manner to secure the belt portions and the spring clip 300 to the belt. The spring member 330 includes a first end 336, a middle portion 338 and a second end 340; in some embodiments, the middle portion 338 of the spring member has a channel or slot 332 to increase the flexibility of the spring member 330.

Figure 8:
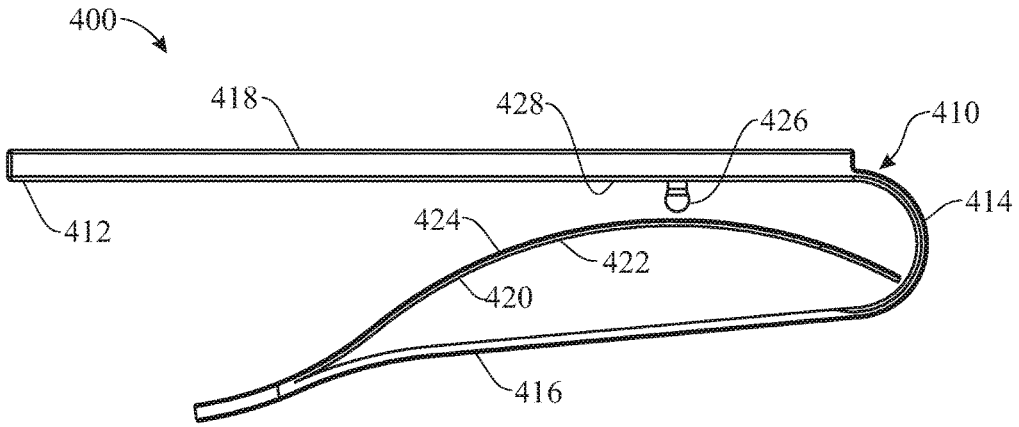
FIG. 8 presents a side elevation view of a further embodiment of a belt securing clip of the present invention showing a spring button attached to the belt securing clip to help secure the belt securing clip to a belt.

Referring now to FIG. 8, there is disclosed a third embodiment of a belt clip 400 of the present invention. The belt clip 400 is similar to the belt clip 100 described hereinabove and generally includes a body portion 410 having a first portion 412, a middle portion 414 and a second portion 416. A plate 418 is provided on the first portion 412 and may be removably or permanently attached thereto or formed integrally therewith. A spring member 420 is provided and attached to the second portion 416 in a manner substantially identical to that described hereinabove with regard to the spring member 120 of the belt clip 100. Similarly to the previous embodiments, the spring member 420 has a concave surface 422 and a convex surface 424.

In the embodiment shown in FIG. 8, in order to even more firmly secure the belt clip 400 about a belt and any loose length of the belt, the belt clip 400 includes a button 426 engageable with a portion of a user's belt. The button 426 is provided on a generally planar inner surface 428 of the first portion 412 and extends toward the convex surface 424 of the spring member 420. Alternatively, the button 426 may be provided on the convex surface 424 of the spring member 420 and extend toward the inner surface 42.8 of the first portion 412 of the body portion 410 of the belt clip 400.

In use, the belt clip 400 is positioned over a belt and any loose portions of the belt (such as belt 200 and loose length 220) in a manner described above. The button 426 is configured to enter holes (not shown) in the body of the belt and firmly secure the belt clip 400 to the belt. Alternatively, where the portion of the belt engaged by the belt clip 400 does not contain any holes, the button 426 of the belt clip 400 further urges the portions of the belt together against the bias of the spring member 420 to firmly secure the belt portions together and the belt clip 400 to the belt. The button 400 may itself be spring biased such that the button 400 is compressible to better allow a belt to be maneuvered in between the first portion 412 and 416. The button 400 may be compressed while maneuvering a belt to engage the button 400 into a hole of the belt. The button 400 may include various friction providing surfaces, or may alternatively include a rotatable ball to allow the button 400 to glide along a belt before engaging into a hole of the belt.

In further alternative embodiments, the belt clip can include magnetically-attracted first and second body portions, which are sufficiently strongly attracted to secure belt clip to a belt arranged therethrough. The magnetic force between the first body portion and the opposing second body portion forces the body portions to come together to clip onto the belt.

The disclosed embodiments may be formed from a variety of the disclosed materials or other rigid and flexible materials. Additionally, the features of any one embodiment are not limited to that embodiment but may be incorporated into any of the disclosed embodiments.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A belt clip for retaining an excess amount of belt material of a belt, comprising:

a body portion having a first portion, a middle portion and a second portion arranged in a spaced-apart relationship with the first portion, the first portion including a free, first end and a second end extending from the middle portion, the second portion including a first end and a second end extending from the middle portion;

an arcuate spring member having a first end, a middle portion and a second end, the first end of the spring member extending from the first end of the second portion and the middle portion of the spring member having a concave surface and a convex surface;

wherein the belt clip further includes a plate extending from the first portion of the body portion, the plate and the first portion having a total thickness greater than the thickness of the second portion of the body portion; and wherein the plate is removably attachable to the first portion of the body portion.

2. The belt clip of claim 1, wherein the body portion is generally U-shaped.

3. The belt clip of claim 1, wherein the middle portion of the body portion is curved.

4. The belt clip of claim 1, wherein the first and second portions define a channel therebetween for receipt of a section of a belt and the spring member extends from the first end of the second portion through the channel to a point adjacent an inner surface of the middle portion.

5. The belt clip of claim 1, wherein the convex surface of the spring member faces an inner surface of the first portion and the concave surface of the spring member faces an inner surface of the second portion.

6. The belt clip of claim 1, wherein the spring member is more flexible than the body portion.

7. The belt clip of claim 1, wherein the middle portion of the spring member comprises a slot.

8. The belt clip of claim 1, wherein the second portion of the body portion comprises a bend separating an entrance end portion of the second portion from a channel portion of the second portion.

9. The belt clip of claim 8, wherein the bend causes the entrance end portion to angle away from the first end of the first portion to create a flared entrance opening in a channel defined between the first and second portions.

10. The belt clip of claim 1, wherein the plate includes at least one of indicia, an alphanumeric character and an image on an outer surface thereof.

11. The belt clip of claim 1, wherein the plate is slidably insertable within a receiving channel formed on the first portion of the body portion.

12. The belt clip of claim 11, wherein the first portion includes first and second raised sides and a raised end wall defining the receiving channel.

13. The belt clip of claim 11, wherein the plate is removably secured within the receiving channel in friction fit fashion.

14. The belt clip of claim 1, further comprising a button for engagement with the belt, the button extending from an inner surface of one of the first or second portion of the body portion towards the other of the first or second portion of the body portion.

15. The belt clip of claim 14, wherein the button extends from an inner surface of the first portion towards the convex surface of the spring member.

16. The belt clip of claim 14, wherein the button extends from the convex surface of the spring member towards an inner surface of the first portion.

17. A belt clip for retaining an excess amount of belt material of a belt, comprising:

a generally U-shaped body portion having a first portion, a second portion arranged in a spaced-apart relationship with the first portion, and a curved middle portion connecting the first and second portions, the first portion including a free, first end and a second end extending from the middle portion, the second portion including a first end and a second end extending from the middle portion;

an arcuate spring member having a first end, a middle portion and a second end, the first end of the spring member being attached to the first end of the second portion and the middle portion of the spring m ember having a concave surface and a convex surface;

wherein the belt clip further includes a plate extending from the first portion of the body portion, the plate and the first portion having a total thickness greater than the thickness of the second portion of the body portion; and wherein the plate is removably attachable to the first portion of the body portion.

18. A belt clip for retaining an excess amount of belt material of a belt, comprising:

a generally U-shaped body portion having a first portion, a curved middle portion and a second portion, the first portion including a free, first end a second end extending from the middle portion, the second portion including a first end and a second end extending from the middle portion, wherein the first portion and the first end of the second portion form a flared entrance opening into a channel defined between the first and second portions;

an arcuate spring member extending into the channel and having a first end, a middle portion and a second end, the first end of the spring member being attached to the first end of the second portion and the middle portion of the spring member having a concave surface and a convex surface, wherein the concave surface is arranged facing an inner surface of the first portion of the body portion, wherein the belt clip further includes a plate extending from the first portion of the body portion, the plate and the first portion having a total thickness greater than the thickness of the second portion of the body portion; and wherein the plate is removably attachable to the first portion of the body portion.

* * * * *